US011667364B2

(12) United States Patent
Despineux et al.

(10) Patent No.: US 11,667,364 B2
(45) Date of Patent: Jun. 6, 2023

(54) FOLDING PROPELLER AND METHODS OF USE

(71) Applicant: Torqeedo GmbH, Wessling (DE)

(72) Inventors: Frank Despineux, Wessling (DE); Janus Milojevic, Munich (DE)

(73) Assignee: Torqeedo GmbH, Wessling (DE)

( * ) Notice: Subject to any disclaimer, the term of this patent is extended or adjusted under 35 U.S.C. 154(b) by 23 days.

(21) Appl. No.: 17/454,490

(22) Filed: Nov. 11, 2021

(65) Prior Publication Data

US 2022/0144398 A1 May 12, 2022

(30) Foreign Application Priority Data

Nov. 12, 2020 (DE) ..... 10 2020 129 938.9

(51) Int. Cl.
*B63H 1/24* (2006.01)

(52) U.S. Cl.
CPC ..... *B63H 1/24* (2013.01)

(58) Field of Classification Search
CPC ... B63H 1/00; B63H 1/02; B63H 1/12; B63H 1/14; B63H 1/20; B63H 1/22; B63H 1/24
USPC ..... 440/49, 66, 79; 416/142, 223 B, 223 R, 416/227 A, 239
See application file for complete search history.

(56) References Cited

U.S. PATENT DOCUMENTS

| | | | | |
|---|---|---|---|---|
| 866,369 | A | 9/1907 | Learnard | |
| 6,152,693 | A * | 11/2000 | Olsen | B63H 1/24 416/142 |
| 10,214,269 | B2 * | 2/2019 | Skrydstrup | B63H 1/22 |

FOREIGN PATENT DOCUMENTS

| | | | |
|---|---|---|---|
| AU | 44106/79 | A1 | 2/1979 |
| EP | 0140233 | B1 | 3/1987 |
| GB | 2015456 | B | 4/1982 |
| JP | S62192995 | U | 12/1987 |

OTHER PUBLICATIONS

"Torqeedo Katalog 2009," 2009, 24 pages.
"Operating Manual Ultralight 402," Sep. 15, 2009, 64 pages.
"Torqeedo Katalog 2010," 2010, 24 pages.
"Torqeedo Katalog 2011," 2011, 24 pages.
"Torqeedo Katalog 2012," 2012, 32 pages.
"Torqeedo Katalog 2013," 2013, 21 pages.
"Torqeedo Katalog 2014," 2014, 46 pages.
"Torqeedo 2015," 2015, 64 pages.
"Torqeedo Electric Boating 2016," 2016, 74 pages.
"Operating Manual Ultralight 403," Mar. 22, 2016, 72 pages.
Güldenring, Sabine, "Service Manual Ultralight 403 and 1103," Mar. 23, 2016, 17 pages.

(Continued)

*Primary Examiner* — Daniel V Venne

(74) *Attorney, Agent, or Firm* — Greenberg Traurig, LLP; David J. Dykeman; Roman Fayerberg

(57) ABSTRACT

The present disclosure relates to a folding propeller, comprising a hub, which may be driven via a drive shaft around a rotation axis, at least two propeller blades, which are pivotably arranged on the hub between a folded position and an unfolded position, and a propeller blade arresting means, which is configured for arresting the propeller blades in the unfolded position, wherein the propeller blade arresting means is movable relative to the hub in rotation direction between a starting position and an arresting position.

20 Claims, 7 Drawing Sheets

(56) References Cited

OTHER PUBLICATIONS

"Torqeedo Electric Boating 2017," 2017, 76 pages.
"Torqeedo Electric Boating 2018," 2018, 76 pages.
"Torqeedo Elektromobilität auf dem Wasser 2019," 2019, 76 pages.
"Ultralight 403 A/AC 1103 AC original operating instructions", Jan. 25, 2019, 131 pages.
Ultralight 403 A (320W) Drawing No. TQ-1405-00, Jan. 30, 2019, 1 page.
Ultralight 1103 AC (915Wh) Drawing No. TQ 1408-00_IND, Aug. 21, 2019, 2 pages.
Ultralight 1103 AC (915Wh) Drawing No. TQ 1408-000, Aug. 21, 2019, 1 page.
"Torqeedo Elektromobilität auf dem Wasser 2020," 2020, 72 pages.
"Addendum to the Ultralight 1103 AC User Manual," Jan. 13, 2020, Version 1.1, 2 pages.

* cited by examiner

FOLDING PROPELLER AND METHODS OF USE

RELATED APPLICATIONS

This application claims the benefit of and priority to German Application No. DE 10 2020 129 938.9, filed Nov. 12, 2020, which is incorporated herein by reference in its entirety.

TECHNICAL FIELD

The present disclosure relates to a folding propeller comprising a hub that can be driven via a drive shaft around a rotation axis, and at least two propeller blades pivotably arranged on the hub between a folded position and an unfolded position. Such folding propellers are typically used in motor drives for sailing boats.

BACKGROUND

It is known to use auxiliary drives with folding propellers in sailing boats because of their advantageous flow characteristics when not in use. These are normally folding propellers, which have two or more propeller blades, which usually are mounted transverse to the propeller hub and are substantially freely movable. This principle basically allows two operating states. The first operating state exists when the propeller blades are axially folded backwards, which is for example the case when the drive shaft is standing still. The second operating state occurs when the drive shaft rotates and is defined in that the propeller blades are radially folded outwards in order to be able to apply thrust to the boat in this way.

In the simplest case the propeller blades are unfolded during forward as well as during reverse travel thanks to centrifugal forces. In most cases the propeller blades are coupled to each other at their root end to guarantee a synchronous opening of the propeller blades. This prevents that strong imbalances occur at the drive shaft when opening the propeller blades. If the folding propeller is rotated in a direction that equals forward travel, the thrust generated by the propeller blades pushes the propeller blades into a completely opened position from a certain opening angle of the propeller blades. Centrifugal force as well as thrust therefore generate an opening torque at the propeller blades.

This works very well during forward travel. However, during reverse travel an unfolding of the propeller is more difficult to realise, which reduces the efficiency of the known folding propellers during reverse travel. The thrust generated at the propeller blades effects a closing torque at the propeller blades during reverse travel. If a flow equalling forward travel is also applied to the folding propeller, this inflow also effects a closing torque at the propeller blades. Only centrifugal force effects an opening torque and therefore counteracts thrust and also inflow. As a result the propeller blades often reach only a partly unfolded position during reverse travel. Relatively high speeds are therefore necessary during reverse travel, and in particular when halting, to counteract the centrifugal force of the other closing torques. The efficiency of the folding propeller is therefore normally quite low during reverse travel.

SUMMARY

Based on known prior art it is an objective of the present disclosure to provide an improved folding propeller.

This objective is solved by a folding propeller with the features of claim 1. Advantageous further developments result from the subclaims, the description and the Figures.

Accordingly, a folding propeller is suggested, comprising a hub that can be driven via a drive shaft around a rotation axis, at least two propeller blades, which are arranged pivotably mounted on the hub between a folded position and an unfolded position, and a propeller blade arresting means, which is configured for arresting the propeller blades in the unfolded position.

According to the disclosure the propeller blade arresting means is movable relative to the hub in rotation direction between a starting position and an arresting position.

The arrangement of the propeller blades on the hub that is pivotable between a folded position and an unfolded position enables two operating states. In the folded position of the propeller blades the folding propeller is in a first operating state, in which the alignment of the propeller blades is oriented axially backwards. This state substantially occurs only when the drive shaft is standing still. In the unfolded position of the propeller blades the folding propeller is in a second operating state, which occurs when the drive shaft rotates. The alignment of the propeller blades is oriented radially outwards in this second operating state. The folded position and/or the unfolded position can be predetermined end positions here, between which the propeller blades can be pivoted.

The pivotability of a single propeller blade can be uncoupled from further propeller blades here, or the propeller blades can be coupled with each other with regard to pivotability. Particularly, the folding propeller can have two or three propeller blades, wherein the pivotability of each one is uncoupled from the pivotability of the further propeller blades or is coupled with the same.

Not all propeller blades present need to be arrested directly by the propeller blade arresting means in the sense of the present disclosure. Notwithstanding, all propeller blades present may be arrested above the propeller blade arresting means.

An arresting position in the sense of the present disclosure is understood as a position of the propeller blade arresting means that is relative to one propeller blade or to several propeller blades, in which the pivotability of the propeller blade or the propeller blades is limited compared to the pivotability of the propeller blade or the propeller blades in the starting position.

The arresting position may be a position in which the propeller blades are wholly or partly unfolded and are secured against folding by the propeller blade arresting means. In particular the arresting position may be a position in which the propeller blades are completely unfolded and are arrested in this position by the propeller blade arresting means in such a way that a pivoting of the propeller blades cannot occur as long as the propeller blade arresting means is in the arresting position relative to the hub.

According to an advantageous further development the propeller blade arresting means is connected with the drive shaft in a torsion proof (German expression:"drehsteif") way, wherein the hub is uncoupled from the propeller blade arresting means in rotation direction, wherein the propeller blade arresting means preferably has a sleeve.

According to some embodiments, the folding propeller therefore has two components that are movable relative to each other in rotation direction, wherein the first component comprises the drive shaft and the propeller blade arresting means, and the second component comprises the hub and the propeller blades.

The drive shaft and the propeller blade arresting means may therefore be designed as one component, which may be a single piece or consist of several parts.

The fact that the propeller blade arresting means may have a sleeve means that the hub that is uncoupled from the propeller blade arresting means in rotation direction may for example be arranged in the interior of the sleeve. This guarantees a simple positioning and assembly of the hub including the propeller blades pivotably arranged on the hub.

The hub is advantageously configured to be movable in such a way that a movement of the hub from the starting position into the arresting position is enforced when applying a torque.

The term enforced may mean that a stop may be provided between two parts which are movable relative to each other.

The term torque is to be understood in the sense of the present disclosure as a torque acting on the drive shaft, from which a corresponding movement of the hub relative to the propeller blade arresting means occurs.

In other words, the hub may be configured together with the propeller blades arranged on the same in such a way that a movement of the hub from the starting position into the arresting position, in which the propeller blades are arrested, is enforced when a torque is applied to the drive shaft, and thus also to the propeller blade arresting means that is connected in a torsion proof way with the same.

According to an advantageous further development the hub may be configured to be movable in such a way, that by utilisation of a torque applied to the hub by the propeller blade arresting means, a movement of the hub from a starting position into an arresting position, in which the propeller blades are arrested, is enforced.

The torque of the drive shaft and the propeller blade arresting means acts against the stoppage here, which is generated by the—at least partly—unfolded propeller blades, so that the propeller blade arresting means is forced against the hub by applying the torque in such a way that the above-mentioned movement is achieved.

According to an advantageous further development the hub may be configured to be movable in such a way that a movement of the hub from the starting position into the arresting position, in which the propeller blades are arrested, is enforced by utilising the mass inertia of the hub.

This way, the mass inertia of the hub and the propeller blade arranged on the same may be utilised to support the movement of the propeller blade arresting means into the arresting position if a relative acceleration is applied between the components uncoupled from each other.

Mass inertia is generally to be understood as an inertia moment, also mass inertia moment or inertial moment, which specifies the inertia of a body in question in relation to a change in its angular speed whilst rotating around the rotation axis (torque divided by angular acceleration).

Utilising mass inertia means that mass inertia substantially causes the movement of the propeller blade arresting means from its starting position into its arresting position, relative to the hub. This may be realised in that an inert body, the mass inertia of which is used to force the hub into the arresting position when rotation of the hub is accelerated, has sufficient mass and a suitable mounting. The detailed implementation of this will further depend on the angular speed and dimensions, which may be determined with the aid of simple trials. Decisive is that the hub is placed in the arresting position for a specific application from a desired angular acceleration of the drive shaft and the propeller blade arrangement means based on its mass inertia torque relative to the propeller blade arresting means.

According to another advantageous further development the hub is connected with the drive shaft in a torsion proof way, wherein the propeller blade arresting means is uncoupled from the hub in rotation direction, wherein the propeller blade arresting means preferably has a sleeve.

In some embodiments, only the propeller blade arresting means is for example uncoupled in rotation direction, wherein the drive shaft, the hub and the propeller blades pivotably mounted on the hub are connected in a torsion proof way with each other. This has the advantage that the force flow from the shaft to the propeller blades remains unchanged, which may lead to avoiding a re-design of the drive train.

The sleeve may preferably be arranged on the outside of the hub in some embodiments. The propeller blade arresting means may be easily integrated into the hub in this way without having to make substantial changes to the hub. The propeller blade arresting means may also be integrated into the hub without the flow in the vicinity of the folding propeller being significantly influenced. Lastly a sleeve is a cost effective and easily manufactured component, which can simply be replaced or retrofitted if necessary.

It is of further advantage if the propeller blade arresting means is configured to be movable in such a way that a movement of the propeller blade arresting means from a starting position into an arresting position, in which the propeller blades are arrested, is enforced by means of utilising mass inertia that occurs when rotating the hub.

In some embodiments, mass inertia substantially causes the movement of the propeller blade arresting means from its starting position into its arresting position relative to the hub. Sufficient acceleration or sufficient angular acceleration must accordingly be applied for this, which leads to the relative movement being performed.

It can further be of advantage if the propeller blade arresting means may be configured to be movable in such a way that its mass inertia is utilised in a targeted way to enforce the movement of the propeller blade arresting means from the starting position into the arresting position.

The function of arresting may thus be guaranteed with the propeller blade arresting means alone. The propeller blade arresting means may therefore also be designed as a retrofit component, with which conventional folding propellers may be equipped. In addition, the remaining components of the folding propeller do not need to be modified, or only a little, to guarantee the function of arresting the propeller blades.

According to an advantageous further development the effect of the mass inertia of the propeller blade arresting means may be supported or replaced through flow bodies that generate flow forces. Such flow bodies may for example be blades, ribs, lamellae or other devices on the propeller blade arresting means. These flow bodies are preferably configured in such a way that they, much like the inertia of the propeller blade arresting means, counteract a change in rotation speed (in particular in a reverse direction) in order to make the propeller blade arresting means stand still whilst the propeller starts to rotate backwards.

According to some embodiments, such flow bodies, in particular blades, may be of a collapsible or foldable design, so that the same may lie against the hub during forward rotation (low water resistance), whilst they stand upright during reverse travel to support inertia. This has the advantage that the propeller blades may be locked reliably during reverse travel rotation and that the flow body folds up again during a hydrogeneration of the flow bodies because the same then rotates forwards. A direction dependent enforcement of any effect may thus be created, which also gives rise to mass inertia.

According to an advantageous further development the rotation direction equals a reverse operation of the propeller blades. An unfolding of the propeller blades may in principle take place during forward travel as well as during reverse travel, therefore in both directions.

When the propeller blades are driven via the drive shaft and set to rotate, they induce impulse forces corresponding to their blade geometry onto the adjacent fluid. During forward travel the counter forces acting on the propeller blade increase the unfolding of the propeller blades. However, during reverse travel it may happen that the counter forces occurring during the same cause a closing torque on the propeller blades, which will lastly lead to a folding of the propeller blades into the folded position. This disadvantageous effect may be suppressed by the propeller blade arresting means.

Approaches of adapting the profiles of the propeller blades in such a way that a folding of the propeller blades during reverse gear becomes more unlikely are known from prior art. If the buoyancy generated is for example lower in reverse gear, the speed for a specific thrust must be correspondingly higher, which causes the correspondingly higher centrifugal forces to make a folding more unlikely. The presence of the propeller blade arresting means has the advantage that the propeller blades may also be configured in such a way that a high thrust is generated in reverse gear at low speed, as a folding into the folded position is indirectly prevented.

As a result, the propeller blades may be configured in such a way that they generate optimal buoyancy even during reverse travel. In this way reverse travel may also be reliably induced at low speeds. The often-used practice of specifically increasing the speed of the hub for inducing reverse travel in order to provide sufficient centrifugal force may thus be omitted. The folding propeller may therefore be used in a more environmentally friendly, reliable and quieter way.

The fact that the arresting position is enforced by means of using mass inertia that occurs when the hub rotates means that a self-adjusting arresting of the propeller blades may be realised, which occurs solely through rotating the hub. In addition, a controlled opening during reverse travel and during towing is guaranteed. The efficiency and also the calculability of the folding propeller is improved in this way.

Further, efficiency during hydrogeneration (recuperation), for example during sailing operation, may be improved by using the suggested arrestable folding propeller. Hydrogeneration operation may be implemented particular efficiently in this way.

In some embodiments, the propeller blades are mounted on a bearing pin arranged transverse to the rotation axis. The propeller blades may firstly be folded up in an axis-parallel way, and secondly pivoted onto a rotation plane that lies orthogonal to the rotation axis. The propeller blades of this construction type may also be replaced easily and fitted to the hub by means of commercially available bolts and/or safety devices.

According to an advantageous further development the propeller blade arresting means is configured in such a way that the same is in the starting position when the drive shaft stands still, wherein the propeller blades are freely pivotable between the folded position and the unfolded position in this case. If there is therefore no rotation of the drive shaft, and if no mass inertia torque is induced by the same, the propeller blade arresting means is located relative to the hub in the starting position and the propeller blades of the folding propeller are freely pivotable.

The propeller blade arresting means therefore does not act as an arresting component when the drive shaft stands still, which means the folding propeller acts like a conventional folding propeller when the drive shaft stands still. Established assembly, maintenance and cleaning work can consequently be carried out in the same way.

According to an advantageous further development the sleeve of the propeller blade arresting means has a recess and a catch in the area of each propeller blade, wherein the catch is preferably formed on a downstream end of the sleeve.

In the sense of the present application an end of the sleeve is to be understood as a facing side of the sleeve in an axial direction. The downstream end of the sleeve is the end which is oriented downstream during forward travel of the folding propeller. The recess is preferably a part area cut out of the shell surface of the sleeve, in which a propeller blade or a propeller blade root of a propeller blade is held in the unfolded position.

The catch is preferably part of the sleeve. The catch is for example formed in that the recess on the shell surface of the sleeve extends only partly up to the facing side of the downstream side end of the sleeve. The remaining gap between the end of the catch and the adjacent shell surface of the sleeve is preferably so large that a propeller blade may be inserted into and withdrawn from the recess through this gap.

According to some embodiments, where the propeller blade arresting means is connected with the drive shaft in a torsion proof way, the unfolding of the propeller blades is affected or supported by the shape of the recess or the catch in such a way that the propeller blades are unfolded by means of form closure, which results from the forces between the driven propeller blade arresting means and the inert hub.

It may therefore be guaranteed in a simple way that the sleeve is rotated relative to the propeller hub during rotation, utilising mass inertia, is forced into the arresting position and a catch is simultaneously pushed before each propeller blade.

In some embodiments, the propeller blade arresting means has an insertion bevel, which is designed in such a way that a folding of the propeller blades leads to the propeller blade arresting means being reset into its starting position in a state in which the propeller blade arresting means is not yet completely in the arresting position. Vice versa the bevel leads to the propeller blades being pressed down by the bevel during reverse travel.

The insertion bevel can for example be formed on the catch, in particular on one side of the catch, which simultaneously is an edge structure. The catch can for example have a width that tapers towards its free-standing end, wherein the width relates to a dimension that lies on the level of the shell surface. The insertion bevels improve the reliability of the function of the propeller blade arresting means.

According to an advantageous further development the propeller blade arresting means is made from one piece. The propeller blade arresting means can be manufactured cost effectively in this way. Sleeve and catch can for example be milled from one piece, whilst any type of forming, in particular casting, forging or suchlike, is feasible in principle. Alternatively, the sleeve and/or the catch can however also be connected with any kind of joining. The catch can be adapted to follow the shape of the sleeve or can also be freely connected with the same.

The propeller blade arresting means and/or the propeller blades preferably include a metallic material. With regard to the propeller blade arresting means a use of a metallic material has the advantage that the mass inertia torque of the same is increased. As a result, the reliability and calculability of the propeller blade arresting means, and lastly of the folding propeller, is improved with such a one.

According to an advantageous further development the propeller blade arresting means is designed to arrest the propeller blades in an unfolded position when towing the folding propeller, so that an automatic rotation of the propeller blades takes place, wherein the propeller blade arresting means is preferably designed to enable an automatic rotation of the propeller blades for recycling energy from around 5 kn of speed. The propeller blade arresting means can for example have a recess and/or a catch for this, which are designed in such a way that arresting is also guaranteed during forward travel.

In one advantageous further development the propeller blades are configured in such a way that the initial opening of the propeller blades takes place by utilising centrifugal force, preferably wherein the propeller blades include a metallic material, in particular a metal alloy. The initial opening of the propeller blades may take place from an early folded position by utilising centrifugal forces. A reliable and calculable function of the folding propeller may be achieved in this way on the one hand. On the other hand, utilising centrifugal forces for the initial opening of the propeller blades allows the omission of further technical means for opening the propeller blades. The propeller blades may therefore be arranged on the hub pivotable freely.

Use of a metallic material for the propeller blades has the advantage that the initial opening of the blades, which is based on centrifugal force, is simplified by the corresponding mass of the propeller blades. This improves the reliability and the calculability of the propeller blade arresting means, and lastly the folding propeller, with such a one.

An example of a movement cycle of a folding propeller, according to some embodiments, is disclosed in the following for explaining the function of the propeller blade arresting means in more detail by means of an example, according to which the propeller blade arresting means is connected with the drive shaft in a torsion proof way, and the hub is uncoupled from the drive shaft in rotation direction:

The propeller blade arresting means is driven together with the drive shaft from standstill around a rotation axis in a rotation direction, which equals reverse travel.

The angular acceleration of the propeller blade arresting means and the mass inertia of the hub may create a contact between the propeller blade arresting means and the hub. The hub may then be towed by the propeller blade arresting means together with the propeller blades.

Due to the centrifugal forces that act on the propeller blades the propeller blades pivot out of their early folded position into an unfolded position.

When pivoting the propeller blades out of the unfolded position these may each be driven into a recess of the propeller blade arresting means, which forms a corresponding opening. The propeller blades may pass a catch during this, which may be formed on the facing side end of the sleeve.

Upon reaching the unfolded position the propeller blades may be located completely in the recess.

Caused by the rotation of the propeller blade arresting means the torque applied to the hub and the unfolded propeller blades may lead to propeller blades being moved from a starting position into an arresting position within the recess. The arresting may lastly be realised by means of a catch, which may affect an indirect arresting of the propeller blade.

If the rotation is stopped, the propeller blade may move into the starting position thanks to the mass inertia of the hub. The catch in particular is configured such that the same releases the propeller blade, which is in abutment here. The propeller blade may thus be pivoted back out of the unfolded position into the folded position in this abutment.

In some embodiments, in which the hub is connected with the drive shaft in a torsion proof way and the propeller blade arresting means is uncoupled from the hub in rotation direction, functionality is as follows:

The hub is driven by a drive shaft from standstill around a rotation axis in a rotation direction that equals reverse travel.

The rotation of the hub may be transferred directly to the propeller blades, which may pivot from the early folded position into an unfolded position due to centrifugal forces acting on the same.

Upon pivoting into the unfolded position, the propeller blades may each go into a recess in the propeller blade arresting means, which may form a corresponding opening on the facing side end of the sleeve. The propeller blades may pass a catch here, which may be formed on the facing side end of the sleeve.

Upon reaching the unfolded position the propeller blades may be located completely in the recess.

Caused by the rotation of the propeller blades and the hub the mass inertia of the propeller blade arresting means may induce the propeller blades being moved from a starting position into an arresting position within the recess. The arresting may lastly be result from a catch, which may affect an indirect arresting of the propeller blade.

If the rotation is stopped or reduced, the propeller blade arresting means may move into the starting position due to its mass inertia. The catch in particular is designed in such a way that the same may release the propeller blade, which is in abutment here. The propeller blade may thus pivot back out of the unfolded position into the folded position in this abutment.

The functionalities of the propeller blade arresting means described herein are examples and should not be understood as limiting.

The objective of the present disclosure is further solved by means of a drive for a boat with a folding propeller, as described herein. The objective of the present disclosure is further solved by means of a boat with such a drive.

BRIEF DESCRIPTION OF THE FIGURES

Preferred further embodiments of the disclosure will be explained in more detail in the following description of the Figures. Shown are.

DETAILED DESCRIPTION

Exemplary embodiments are described in the following with reference to the Figures. Identical, similar or identically acting elements are identified with identical reference numbers in the various Figures, and a repeated description of these elements is partly omitted to avoid redundancies.

Figure 1:
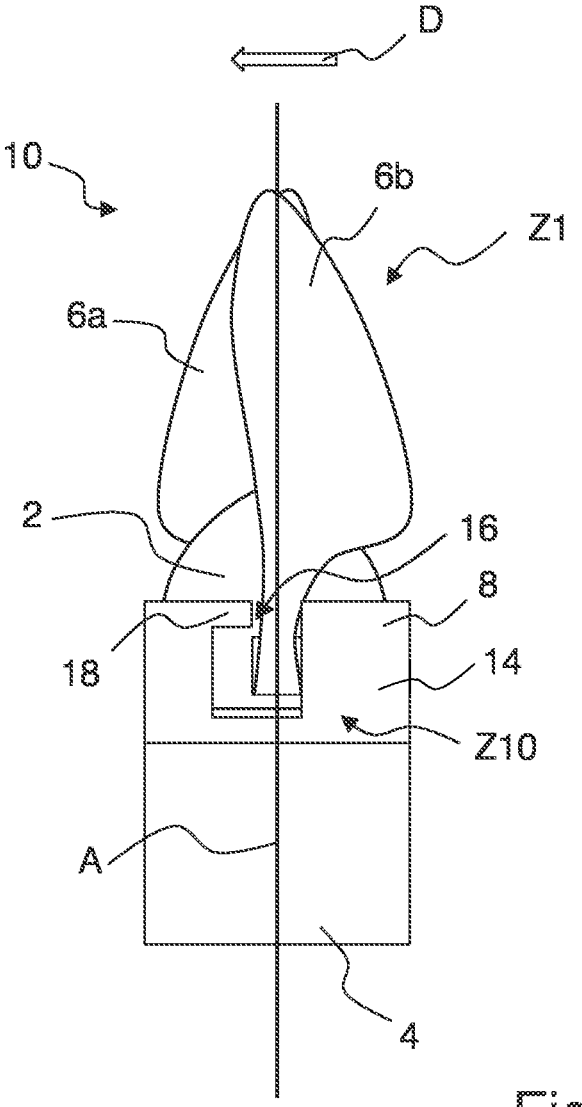
FIG. 1 a schematic view of a folding propeller according to some embodiments in a folded position.

FIG. 1 shows a schematic view of a folding propeller 10 according to some embodiments in a folded position Z1.

The folding propeller 10 comprises a hub 2, which is uncoupled from the drive shaft 4 in rotation direction D. Two propeller blades 6*a*, 6*b* are pivotably arranged on the hub 2. The hub 2 may be driven around a schematically illustrated rotation axis A via the drive shaft 4, namely via a propeller blade arresting means 8, which is permanently, and therefore connected in a torsion proof way with the drive shaft 4.

The hub 2 and the propeller blades 6*a*, 6*b* arranged on the same therefore form a first component, which is supported in an uncoupled way in rotation direction D in a further component, formed by the drive shaft 4 and the propeller blade arresting means 8.

Figure 2:
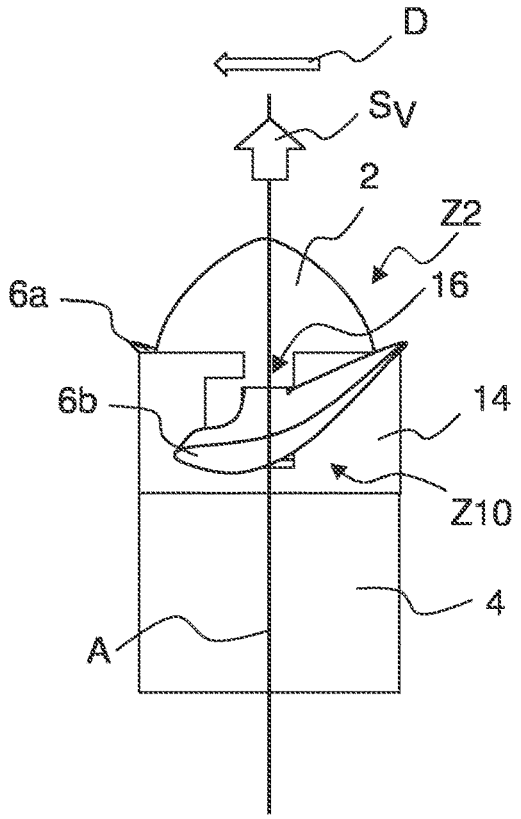
FIG. 2 a schematic view of the folding propeller according to some embodiments in an unfolded position and a propeller blade arresting means in a starting position.

The propeller blades 6*a*, 6*b* are pivotably arranged on the hub 2 between a folded position Z1 and an unfolded position Z2 (for example shown in FIG. 2).

The propeller blade arresting means 8 is equipped for arresting the propeller blades 6*a*, 6*b* in the unfolded position Z2 in order to prevent a (partial) folding of the propeller blades 6*a*, 6*b*, for example during reverse travel, when halting or during hydrogeneration, in this way. The propeller blade arresting means 8 is designed as a sleeve 14 here. The sleeve 14 has a recess 16 formed in its shell surface as well as a catch 18, which is formed on the downstream end of the sleeve 14. The propeller blade arresting means 8 designed as a sleeve 14 is movable relative to the hub 2 in rotation direction D between a starting position Z10 and an arresting position Z20 (for example shown in FIG. 3) together with the drive shaft 4 attached to the same.

Figure 3:
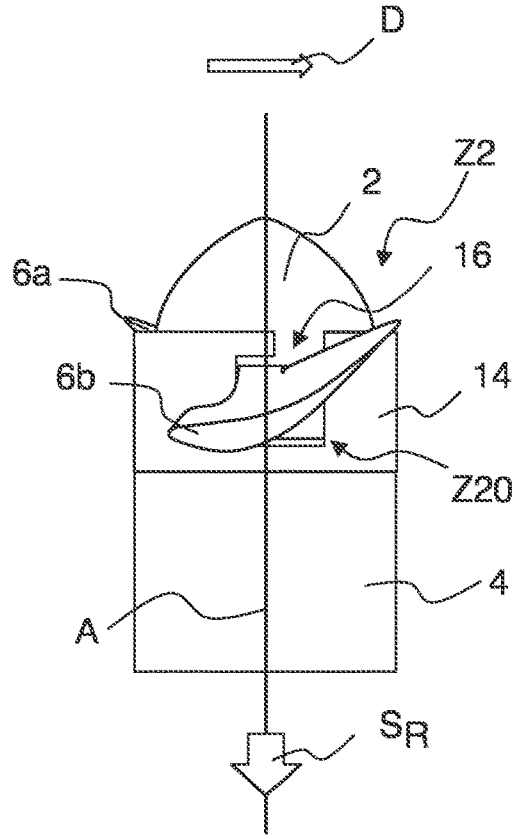
FIG. 3 a schematic view of the folding propeller according to some embodiments in an unfolded position and a propeller blade arresting means in an arresting position.

Accordingly, a relative movement between the hub 2 and the sleeve 14 may for example be achieved by utilising the torque applied by the sleeve 14 to the hub 2, which occurs when rotating the drive shaft 4, and therefore rotating the propeller blade arresting means 8 in form of the sleeve 14. The hub 2 is inhibited together with the propeller blades 6*a*, 6*b* arranged on the same by its movement through water, so that correspondingly, it provides a counter torque, and by means of which the torque applied by the propeller blade arresting means 8 to the hub 2 induces a movement between the propeller blade arresting means 8 and the hub 2. This way, a movement of the sleeve 14 relative to the hub 2 may be enforced from a starting position Z10, as illustrated in FIG. 1, into an arresting position Z20, as illustrated in FIG. 3.

A schematic view of the folding propeller 10 according to some embodiments in an unfolded position Z2 is illustrated in FIG. 2, wherein the propeller blade arresting means 8 is still located in the starting position Z10 relative to the hub 2. The illustration shown in FIG. 2 approximately equals the case that occurs when the folding propeller 10 is in forward travel. Rotation direction D is therefore one that equals forward travel.

The unfolding of the propeller blades 6*a* and 6*b* from the folded position Z1 shown in FIG. 1 into the unfolded position Z2 is realised through rotating the drive shaft 4 together with the propeller blade arresting means 8, which lastly acts on the hub 2 across the propeller blades 6*a*, 6*b*. As soon as the propeller blades 6*a*, 6*b* are set to rotate a centrifugal force acts on the same, which promotes an unfolding of the propeller blades 6*a*, 6*b* and thus generates an opening torque on the propeller blades 6*a*, 6*b*. In addition, an opening torque is applied to the propeller blades 6*a*, 6*b* and acts on the propeller blades 6*a*, 6*b* when applying a rotation of the hub 2 and the simultaneous application of a forward thrust resulting from the same.

As can be gathered from the illustration in FIG. 2, in particular from the orientation of the vane profile, that a rotation of the folding propeller 10 in rotation direction D generates a forward thrust $S_v$, generated upwards in the drawing. The resulting counter force, which acts on the propeller blades 6*a*, 6*b*, supports the unfolding of the propeller blades 6*a*, 6*b*. In other words, the propeller blades 6*a*, 6*b* are moved into the unfolded position Z2 by centrifugal force as well as by the reaction forces from the forward thrust generated by means of rotation.

As the forward thrust $S_v$ is applied in this rotation direction D of the drive shaft and no closing torque acts on the propeller blades 6*a*, 6*b*, an arresting of the folding propeller 10 across the propeller blade arresting means 8 is not provided and is not necessary either. The propeller blades 6*a*, 6*b* are being pushed into the unfolded position Z2 at any point in time when a forward thrust is to be applied.

In this state, the propeller blade arresting means 8 in the form of a sleeve 14 therefore remains, as illustrated in FIG. 2, typically in its starting position Z10. Alternatively, or additionally the propeller blade arresting means 8 may also be designed in such a way that an arresting of the folding propeller 10 across the propeller blade arresting means 8 also takes place in rotation direction D, which equals forward travel. In this way the propeller blades 6*a*, 6*b* may be arrested through a "sharp" reverse switch-on as well as a "sharp" forward switch-on.

A schematic view of the folding propeller 10 according to some embodiments in an unfolded position Z2 and a propeller blade arresting means 8 in an arresting position Z20 is illustrated in FIG. 3. The illustration depicted in FIG. 3 for example equals the case that comes about when the folding propeller 10 is driven during reverse travel. Rotation direction D therefore equals reverse travel here. As an additional delivering torque acts on the propeller blades 6*a*, 6*b* in this rotation direction D via reverse thrust $S_R$—for example through an inflow of surrounding water as well as exercising the reverse thrust $S_R$ directed in the closing direction of the propeller blades 6*a*, 6*b*—the closing torque on the propeller blade competes with the centrifugal force acting on the propeller blade. An arresting of the folding propeller 10 across the propeller blade arresting means 8 is therefore necessary or provided, respectively.

To this end, the suggested propeller blade arresting means 8 in the form of a sleeve 14 as well as the hub 2 are designed such that a movement of the hub 2 relative to the sleeve 14 into the arresting position Z20 is enforced by utilising the torque applied to the hub 2, which occurs when rotating the drive shaft 4. In this position, the propeller blades 6*a*, 6*b* are arrested in the arresting position Z20. The difference between the starting position Z10 and the arresting position Z20 can be graphically deduced from a comparison of FIGS. 2 and 3. From this it can be seen that the change in rotation direction D from forward travel into reverse travel results in the sleeve 14 being rotated relative to the hub 2 in such a way in the latter case, see FIG. 3, that the sleeve 14 abuts on the propeller blade 6*a* with another flank, namely with the opposite flank of the recess 16, in which the propeller blade in question 6*b* is located. This is realised in that the torque applied to the hub 2, which occurs when turning the drive shaft 4, is utilised for enforcing a relative movement of the hub 2 relative to the sleeve 14 from a starting position Z10 into an arresting position Z20.

Figure 4:
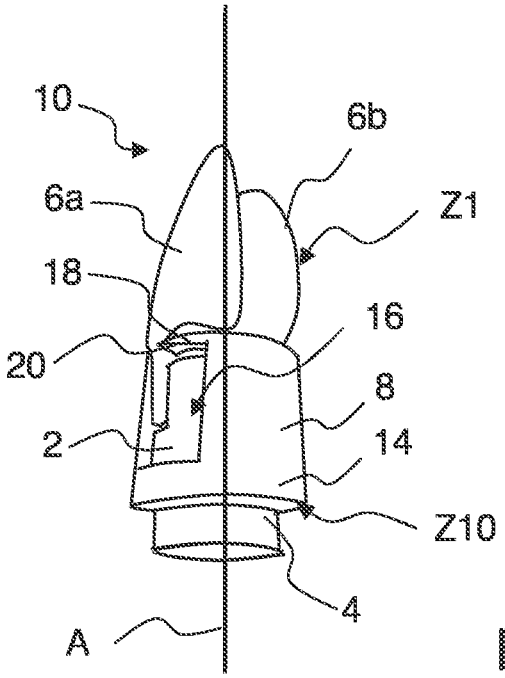
FIG. 4 a schematic view of a folding propeller according to some embodiments in a folded position.

A schematic view of a folding propeller 10 according to some embodiments is illustrated in a folded position Z1 in FIG. 4.

The folding propeller 10 comprises a hub 2, which may be driven around a rotation axis A via a schematically illustrated drive shaft 4. The folding propeller 10 further comprises at least two propeller blades 6*a*, 6*b*, which are pivotably arranged on the hub 2 between a folded position Z1 as illustrated, and an unfolded position Z2 (for example shown in FIG. 5). The folding propeller 10 further comprises a propeller blade arresting means 8 movably coupled with the hub 2, which is configured for arresting the propeller blades 6*a*, 6*b* in the unfolded position Z2 in order to prevent a (partial) folding of the propeller blades 6*a*, 6*b*, for example during reverse travel, when halting or during hydrogeneration, in this way. The propeller blade arresting means 8 is designed as a sleeve 14 here. The sleeve 14 has a recess 16 formed in its shell surface as well as a catch 18, which is formed on the downstream end of the sleeve 14. The catch 18 has an insertion bevel 20. The propeller blade arresting means 8 designed as a sleeve 14 is freely moveable relative to the hub 2 in rotation direction D between a starting position Z10 and an arresting position Z20 (for example shown in FIG. 6).

Figure 6:
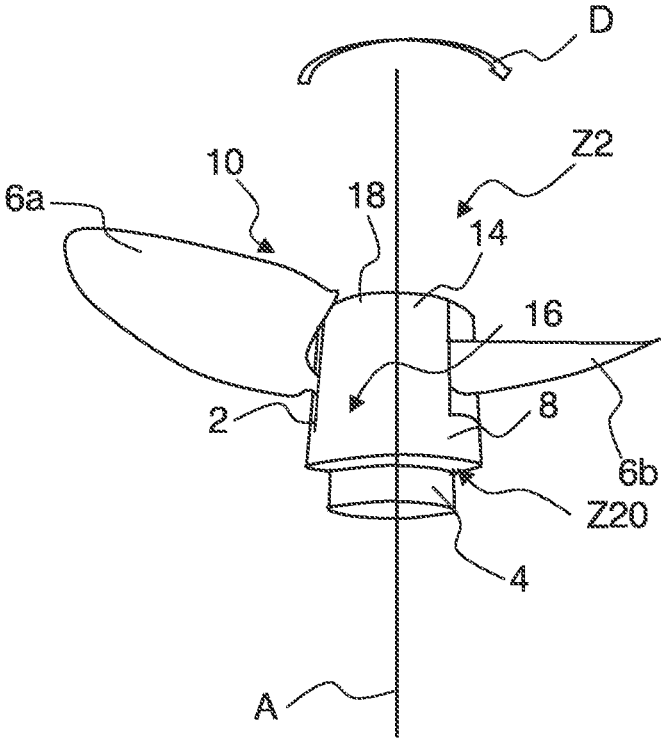
FIG. 6 a schematic view of the folding propeller according to some embodiments in an unfolded position and a propeller blade arresting means in an arresting position.

A relative movement between the hub 2 and the sleeve 14 may accordingly be realised by means of utilising the mass inertia of the sleeve 14, which occurs when accelerating the hub 2. A movement of the sleeve 14 from a starting position Z10, as illustrated in FIG. 4, into an arresting position Z20, as illustrated in FIG. 6, may then be enforced.

Figure 5:
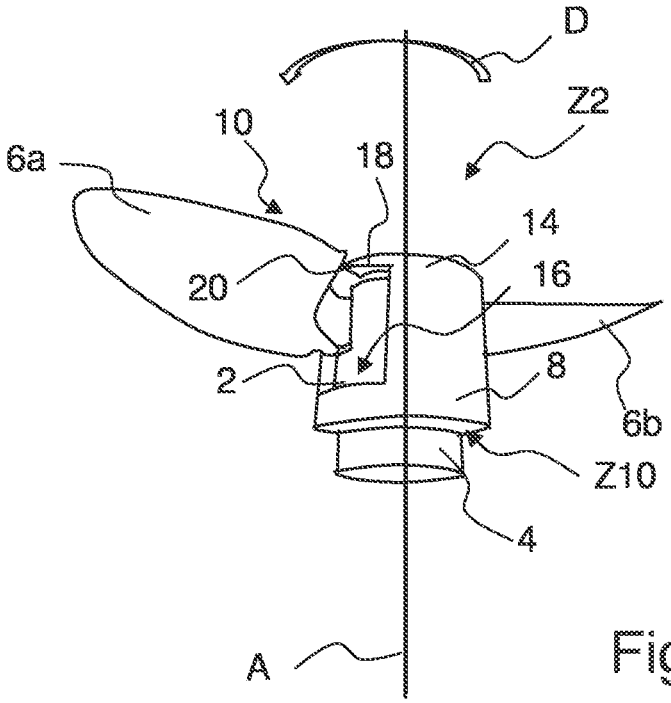
FIG. 5 a schematic view of the folding propeller according to some embodiments in an unfolded position and a propeller blade arresting means in a starting position.

A schematic view of the folding propeller 10 according to some embodiments is illustrated in an unfolded position Z2 in FIG. 5, wherein the propeller blade arresting means 8 is still in the starting position Z10. The illustration shown in FIG. 5 approximately equals the case that comes about when the folding propeller 10 is in forward travel. Rotation direction D is accordingly one that equals forward travel.

The unfolding of the propeller blades 6*a* and 6*b* from the folded position Z1 shown in FIG. 4 into the unfolded position Z2 is realised through a rotation of the hub 2 and the centrifugal force thus acting on the propeller blades 6*a*, 6*b*. An opening torque additionally acts on the propeller blades 6*a*, 6*b* when applying a rotation of the hub 2 and the simultaneous applying of a forward thrust resulting from the same to the propeller blades 6*a*, 6*b*. In other words, the propeller blades 6*a*, 6*b* are moved by the centrifugal force and the forward thrust applied in the unfolded position Z2.

As no closing torque acts on the propeller blades 6*a*, 6*b* in this rotation direction D of the hub 2 in forward thrust direction, an arresting of the folding propeller 10 across the propeller blade arresting means 8 is not provided and is not necessary either. The propeller blades 6*a*, 6*b* are driven into the unfolded position Z2 at any point in time when a forward thrust is to be applied.

The propeller blade arresting means 8 therefore remains in this state, as illustrated in FIG. 2, in the form of a sleeve 14, typically in its starting position Z10. Alternatively, or additionally the propeller blade arresting means 8 may also be designed in such a way that an arresting of the folding propeller 10 via the propeller blade arresting means 8 also takes place in rotation direction D, which equals forward travel. In this way the propeller blades 6*a*, 6*b* may be arrested through a "sharp" reverse switch-on as well as a "sharp" forward switch-on.

A schematic view of the folding propeller 10 according to some embodiments in an unfolded position Z2 and a propeller blade arresting means 8 in an arresting position Z20 is illustrated in FIG. 6. The illustration depicted in FIG. 6 for example equals the case that comes about when the folding propeller 10 is driven during reverse travel. Rotation direction D therefore equals reverse travel here. As a closing torque acts on the propeller blades 6*a*, 6*b* in this rotation direction D—for example through an inflow of surrounding water as well as exercising the thrust directed in the closing direction of the propeller blades 6*a*, 6*b*—an arresting of the folding propeller 10 via the propeller blade arresting means 8 is therefore necessary or provided, respectively.

To this end the suggested propeller blade arresting means 8 in the form of a sleeve 14 is designed in such a way that a movement of the sleeve 14 into the arresting position Z20 is enforced by utilising the mass inertia of the sleeve 14, which occurs when accelerating the hub 2. In this position, the propeller blades 6*a*, 6*b* are arrested in the arresting position Z20. The difference between the starting position Z10 and the arresting position Z20 can be graphically deduced from a comparison of FIGS. 5 and 6. It becomes apparent from this that the change in rotation direction D from forward travel into reverse travel results in the sleeve 14 being rotated relative to the hub 2 in such a way in the latter case, see FIG. 6, that the sleeve 14 abuts on the propeller blade 6*a*. This is realised in that the mass inertia of the sleeve 14, which occurs when accelerating the hub 2, is utilised for enforcing a relative movement of the sleeve14 from a starting position Z10 into an arresting position Z20.

This is achieved not only when reversing the rotation direction, but at any increase of the speed of the hub 2 in rotation direction that equals reverse travel. It may for example be achieved with a rapid rotation of the hub 2 that the propeller blades 6*a*, 6*b* straighten up and it may then be achieved with a further acceleration of the rotation of the hub 2 that the hub 2 quasi turns under the sleeve 14 that remains in its current movement condition due to its inertia, so that an arresting of the propeller blades 6*a*, 6*b* is achieved.

Figure 7:
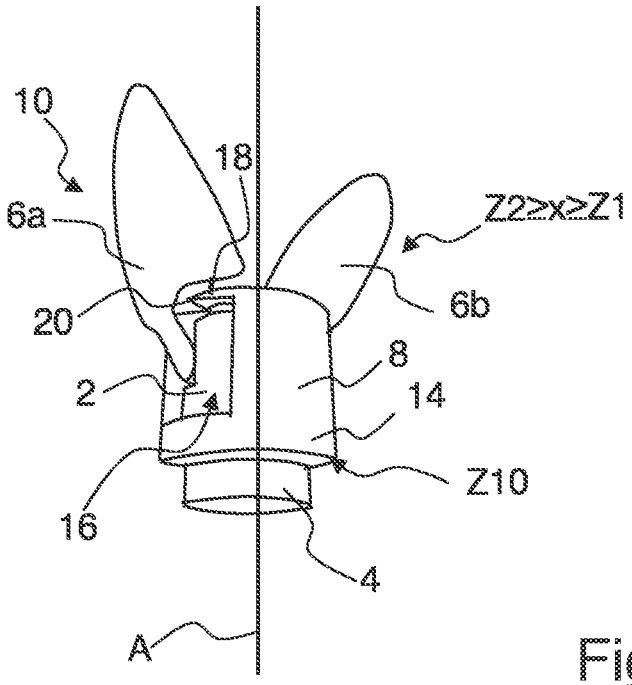
FIG. 7 a schematic view of the folding propeller according to some embodiments in a position that lies between the folded position and the unfolded position.

FIG. 7 shows a schematic view of the folding propeller 10 according to some embodiments in a position that lies between the folded position Z1 and the unfolded position Z2. FIG. 7 substantially serves for demonstrating a transition state of the unfolding process of the propeller blades 6*a*, 6*b*. It can be seen from the illustration in FIG. 7 that the arresting of the propeller blades 6*a*, 6*b* is achieved by means of the catch 18 as long as the hub 2 is driven in reverse travel. The latter can grip the propeller blades 6*a*, 6*b* by means of the insertion bevels 20 before these are completely unfolded.

Figure 8:
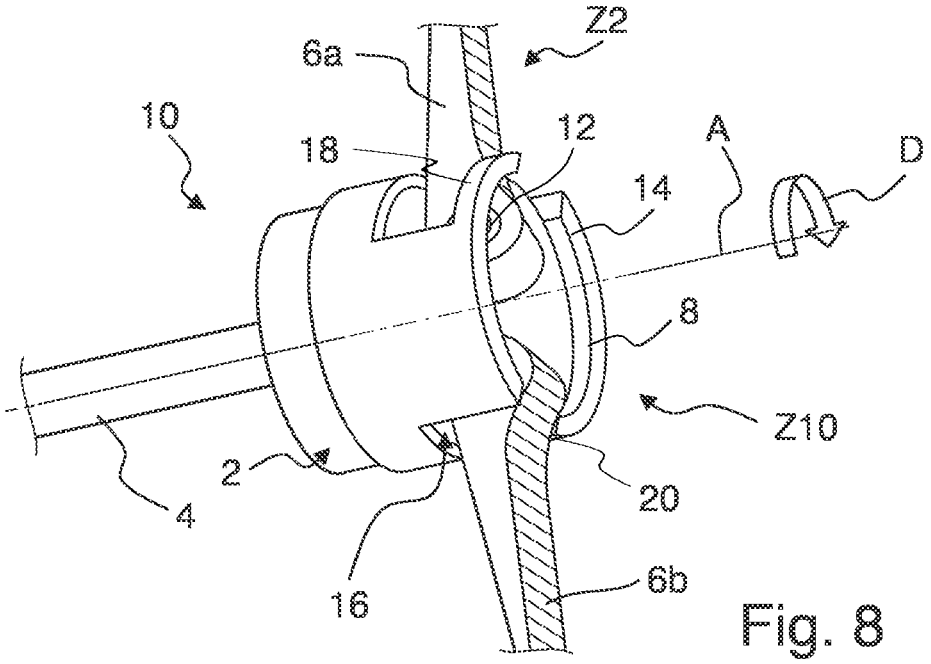
FIG. 8 a schematic view of the folding propeller according to some embodiments in an unfolded position and a propeller blade arresting means in a starting position.

FIG. 8 shows a schematic view of the folding propeller 10 according to some embodiments in an unfolded position Z2, and a propeller blade arresting means 8 in a starting position Z10. It can be seen from the illustration of FIG. 8 that the propeller blades 6*a*, 6*b* are each mounted above a bearing pin 12 that is arranged transverse to rotation axis A. The illustration depicted in FIG. 8 in turn equals the case according to which the folding propeller 10 is driven in rotation direction D, which equals forward travel. As no closing torque acts on the propeller blades 6*a*, 6*b* in this rotation direction D, an arresting of the folding propeller 10 via the propeller blade arresting means 8 is not absolutely necessary. In this state, the propeller blade arresting means 8 in the form of a sleeve 14 may therefore remain in a starting position Z10, as illustrated in FIG. 5. Alternatively, or additionally the propeller blade arresting means 8 may also be designed in such a way that an arresting of the folding propeller 10 is achieved via of the propeller blade arresting means 8 in rotation direction D as well, which equals forward travel.

Figure 9:
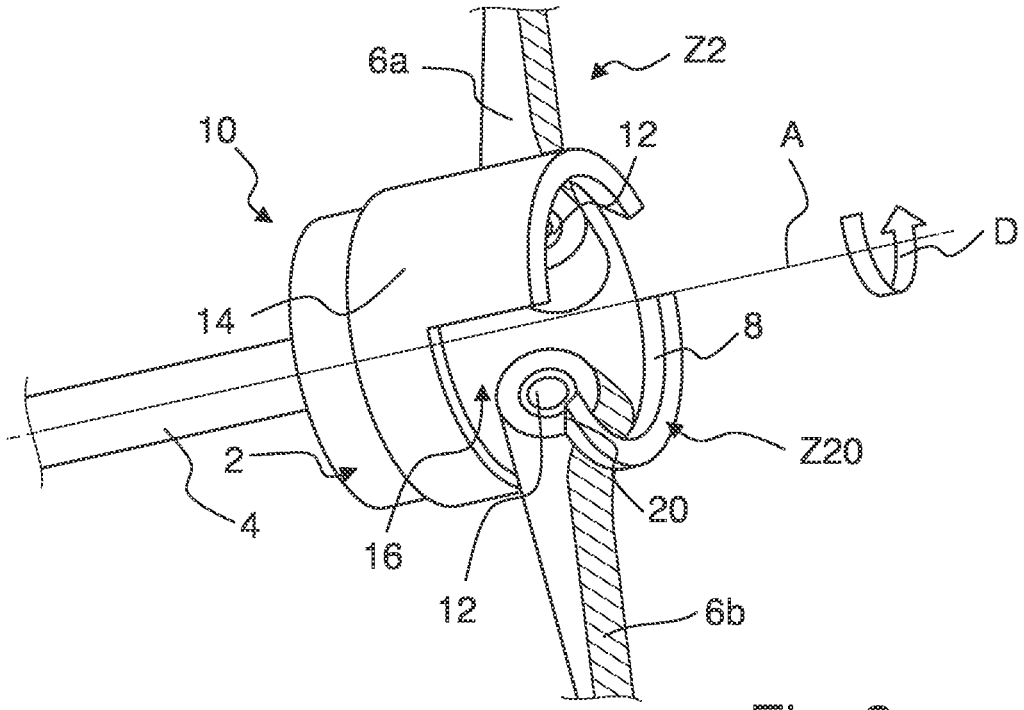
FIG. 9 a schematic view of the folding propeller according to some embodiments in an unfolded position and a propeller blade arresting means in an arresting position.

FIG. 9 shows a schematic side view of the folding propeller 10 according to some embodiments in an unfolded position Z2 and a propeller blade arresting means 8 in an arresting position Z20. Analogous to FIG. 6 the illustration depicted in FIG. 9 equals the case of reverse travel of the folding propeller 10. In this case the folding propeller 10 is driven in rotation direction D, which equals reverse travel. As a closing torque acts on the propeller7 blades 6*a*, 6*b* in this rotation direction D, an arresting of the folding propeller 10 via the propeller blade arresting means 8 is necessary or provided, respectively.

To this end, the propeller blade arresting means 8 is designed in the form of a sleeve 14, so that a movement of the sleeve 14 into the arresting position Z20 is enforced by utilising the mass inertia of the sleeve 14 that occurs when rotating the hub 2. In this position, the propeller blades 6*a*, 6*b* are arrested in the arresting position Z20.

Figure 10:
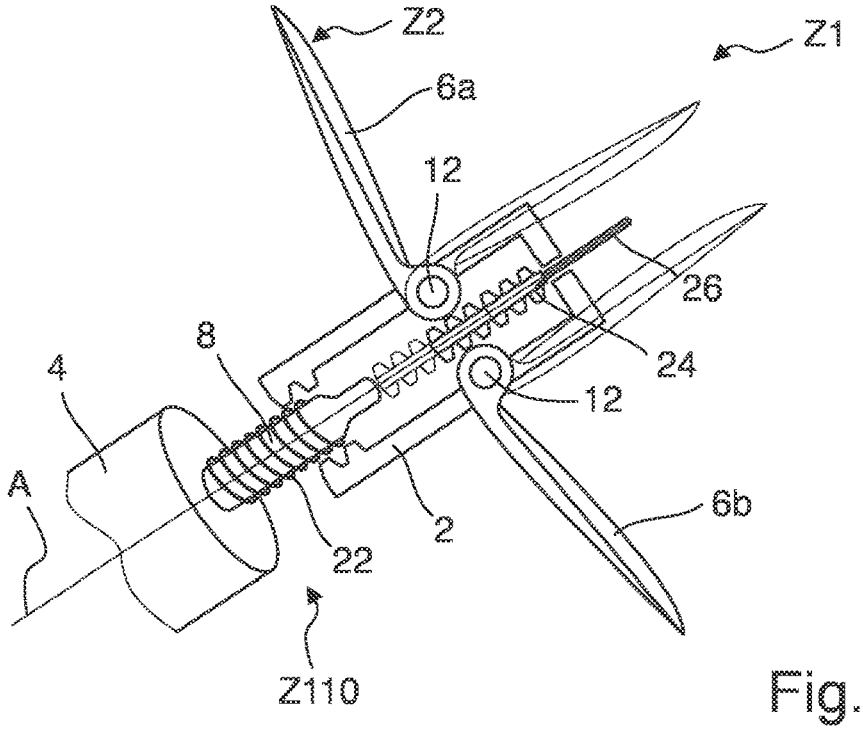
FIG. 10 a schematic side view of a folding propeller according to some embodiments in a first position.

FIG. 10 shows a schematic side view of a folding propeller 10 according to some embodiments in a first position Z110. The folding propeller 10 according to some embodiments also comprises a hub 2, which may be driven around a rotation axis A via the drive shaft 4. Some embodiments further comprise two propeller blades 6*a*, 6*b*, which are pivotably arranged on the hub 2 between a folded position Z1 (illustrated as a dotted line) and an unfolded position Z2. Some embodiments further comprise a propeller blade arresting means 8 coupled with the hub 2, which is configured for arresting the propeller blades 6*a*, 6*b* in the second, unfolded position Z2. The propeller blade arresting means comprises a thread 22 for this.

The propeller blade arresting means 8 according to some embodiments is therefore designed to move relative to the hub 2 in rotation direction D in such a way that a movement of the propeller blade arresting means 8 from a starting position Z10 into an arresting position Z20 (not illustrated in FIG. 10) is enforced by utilising mass inertia that occurs when rotating the hub 2.

An attachment and a thread 22 is arranged on the drive shaft 4. The hub 2 may be screwed onto the thread 22. The special feature of the hub 2 is characterised in that the entire hub 2 can be screwed onto and unscrewed from the drive shaft 4 by means of the thread 22 in the direction of the rotation axis of the drive shaft 4. This screwing mechanism is activated on the basis of the mass inertia of the hub 2 and the drive shaft 4.

Screwing and unscrewing the hub 2 relative to the drive shaft 4 means that the propeller blades 6*a*, 6*b* are mounted freely pivotable transverse to the rotation axis A via the bearing pin 12 in the first state according to FIG. 10. The propeller blades 6*a*, 6*b* are pivoted along their propeller blade roots via a gear rack 24 in a synchronised way. The propeller blades 6*a*, 6*b* may also be controlled via the gear rack 24 in the first state illustrated in FIG. 10. The propeller blades 6*a*, 6*b* are further influenced via a rod 26, which communicates with the gear rack 24.

A further force for opening the propeller blades is introduced in this way, which improves the reliability and optimisation of opening. It is for example possible with this force, which acts only in one direction, to fold the propeller blades 6*a*, 6*b* during forward travel.

The hub 2, the propeller blades 6*a*, 6*b* and the rack 24 may be made from any material here and may in particular include plastic or also metal alloys.

The thread 22 must however consist of a metal alloy in order to withstand the torques and guarantee a sliding along the thread surface. The thread 22 is preferably made from a material, the hardness of which differs from that of the hub 2. This may prevent an occurrence of cold welding.

Figure 11:
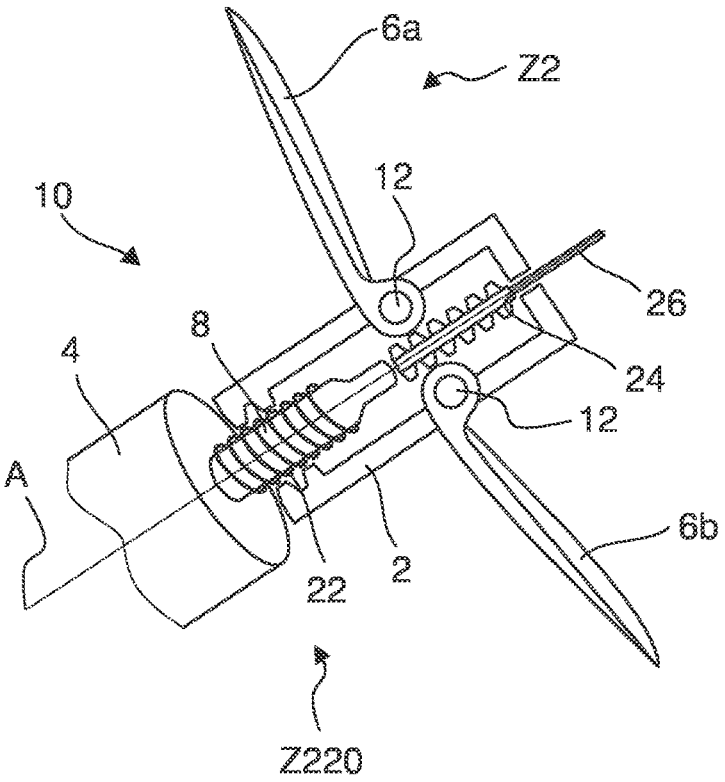
FIG. 11 a schematic side view of the folding propeller according to some embodiments in a second position.

FIG. 11 shows a schematic side view of the folding propeller 10 according to some embodiments of a second position Z220. According to the illustration of FIG. 11 the propeller blades 6*a*, 6*b* are controlled via the gear rack 24 in such a way that the same is in the unfolded position Z2. In addition, the folding propeller 10 is in an arrested position, the second position Z220, which is achieved in that the two components are screwed onto each other due to the mass inertia of the drive shaft 4 and the hub 2.

Figure 12:
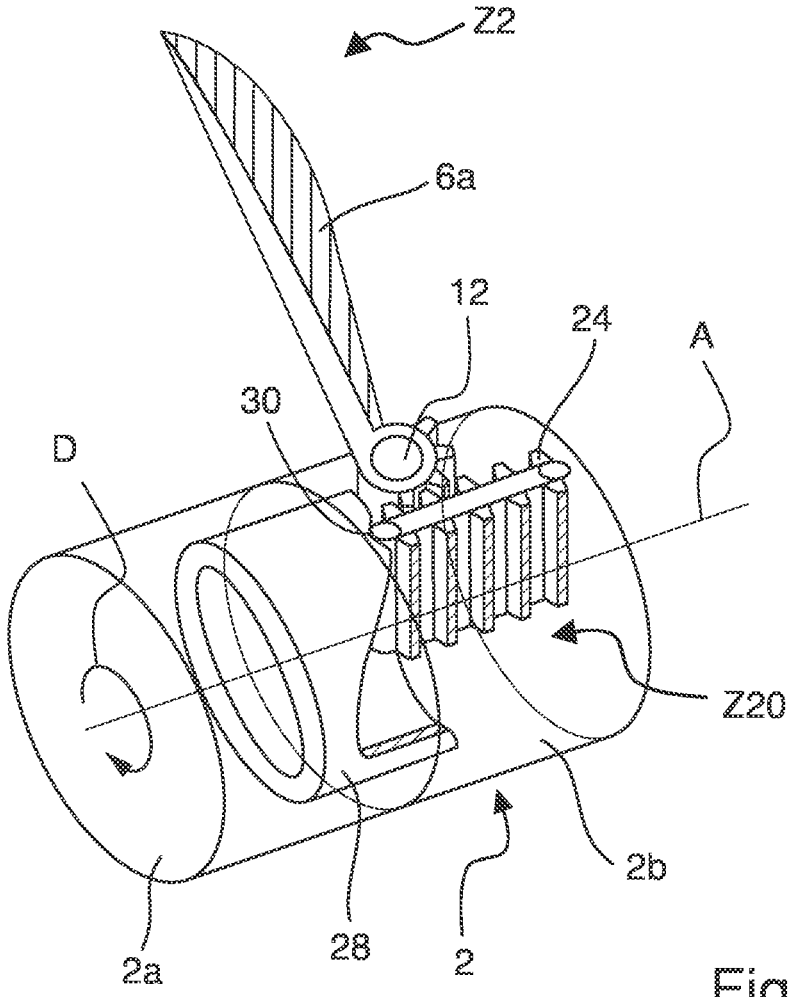
FIG. 12 a schematic perspective view of a folding propeller according to some embodiments in an unfolded position.

FIG. 12 is a schematic perspective view of a folding propeller 10 according to some embodiments in an unfolded position. According to some embodiments the folding propeller 10 comprises a hub 2, which has a first hub element 2*a* and a second hub element 2*b*, wherein the hub 2 may be driven via a drive shaft (not illustrated) around a rotation axis A. Some embodiments further comprise two propeller blades 6*a*, 6*b* (6*b* not illustrated), which are pivotably arranged on the hub 2, as well as a propeller blade arresting means coupled with the hub 2 in the form of a forced hub 28, which is configured for arresting the propeller blades 6*a*, 6*b* in the unfolded position Z2.

The propeller blade arresting means in the form of a forced hub 28 is designed to move relative to the hub 2, in particular the hub element 2*b*, in rotation direction D in such a way that a movement of the propeller blade arresting means in the form of a forced hub 28 into an arresting position Z20, in which the propeller blades 6*a*, 6*b* are arrested, is enforced by utilising mass inertia that occurs when rotating the hub 2.

In some embodiments, the reverse driving torque may be used for arresting instead of or in addition to mass inertia.

Two hub elements 2*a* and 2*b* may twist freely to each other within 90° here. This twisting is induced and controlled by the mass inertia. A forced hub 28, which generates a lift when twisted by 90° and therefore drives a gear rack 24 between the two propeller blades 6*a*, 6*b*, is located in the first hub element 2*a* and may thus control its end position. Some embodiments further have a recess 30 at the forced hub 28, which is located at the tapering end of the 90° twisting and thus acts as an additional resistance against folding.

Additional force for opening the propeller blade 6*a*, 6*b* is therefore introduced, which is to improve the reliability and optimisation of opening. This force acts in one direction only and further allows folding during forward travel. The first hub element 2*a*, the forced hub 28, the gear rack 24 and the propeller blades 6*a*, 6*b* have no material restrictions. These may include plastic as well as metal alloys or consist of the same. The hub element 2*b* has the only restriction that it should be heavier than the hub element 2*a* to realise optimal results. The forced hub 28 as well as the gear rack 24 must be made of materials of a different hardness to avoid cold welding.

Where applicable, all individual features illustrated in the embodiment examples can be combined with and/or exchanged for each other without departing from the scope of the disclosure.

LIST OF REFERENCE NUMBERS

A Rotation axis
D Rotation direction
$S_R$ Reverse thrust
$S_V$ Forward thrust
Z1 Folded position
Z2 Unfolded position
Z10 Starting position
Z20 Arresting position
Z110 First position
Z220 Second position
2 Hub
2*a* First hub element
2*b* Second hub element
4 Drive shaft
6*a*, 6*b* Propeller blade
8 Propeller blade arresting means
10 Folding propeller
12 Bearing pin
14 Sleeve
16 Recess
18 Catch
20 Insertion bevel
22 Thread
24 Gear rack
26 Rod
28 Forced hub
30 Recess

What is claimed is:

1. A folding propeller comprising:

a hub, which can be driven via a drive shaft around a rotation axis (A);

at least two propeller blades pivotably arranged on the hub between a folded position (Z1) and an unfolded position (Z2); and a propeller blade arresting means configured for arresting the propeller blades in the unfolded position, wherein the propeller blade arresting means is movable relative to the hub in rotation direction (D) between a starting position (Z10) and an arresting position (Z20).

2. The folding propeller according to claim 1, wherein the propeller blade arresting means is connected with the drive shaft in a torsion proof way, wherein the hub is uncoupled from the propeller blade arresting means in rotation direction (D), and wherein the propeller blade arresting means has a sleeve.

3. The folding propeller according to claim 2, wherein the hub is configured to be movable in such a way that a movement of the hub from the starting position (Z10) into the arresting position (Z20) is enforced when applying a torque to the drive shaft.

4. The folding propeller according to claim 1, wherein the hub is connected with the drive shaft in a torsion proof way, wherein the propeller blade arresting means is uncoupled from the hub in rotation direction (D), wherein the propeller blade arresting means has a sleeve.

5. The folding propeller according to claim 4, wherein the propeller blade arresting means is configured to be movable in such a way that a movement of the propeller blade arresting means from a starting position (Z10) into an arresting position (Z20), in which the propeller blades are arrested, is enforced by means of utilising mass inertia that occurs when rotating the hub.

6. The folding propeller according to claim 5, wherein the sleeve of the propeller blade arresting means has a recess and a catch in an area of each propeller blade, wherein the catch is formed on a downstream end of the sleeve.

7. The folding propeller according to claim 4, wherein the propeller blade arresting means is configured to be movable in such a way that its mass inertia is utilised in a targeted way for enforcing a movement of the propeller blade arresting means from the starting position (Z10) into the arresting position (Z20).

8. The folding propeller according to claim 1, wherein the rotation direction (D) equals a reverse operation of the propeller blades.

9. The folding propeller according to claim 1, wherein the propeller blades are mounted on a bearing pin arranged transverse to the rotation axis (A).

10. The folding propeller according to claim 1, wherein the propeller blade arresting means are located in the starting position (Z10) when the drive shaft stands still, and wherein the propeller blades are freely pivotable between the folded position (Z1) and the unfolded position (Z2) in this case.

11. The folding propeller according to claim 2, wherein the sleeve of the propeller blade arresting means has a recess and a catch in an area of each propeller blade.

12. The folding propeller of claim 11, wherein the catch is formed on a downstream end of the sleeve.

13. The folding propeller according to claim 1, wherein the propeller blade arresting means has an insertion bevel, which is configured such that, in a state in which the propeller blade arresting means is not yet completely in the arresting position (Z20), a folding of the propeller blades leads to a re-setting of the propeller blade arresting means into its starting position (Z10).

14. The folding propeller according to claim 1, wherein the propeller blade arresting means is made of one piece.

15. The folding propeller according to claim 14, wherein the propeller blade arresting means and/or the propeller blades include a metallic material.

16. The folding propeller according to claim 1, wherein the propeller blade arresting means is configured for arresting the propeller blades in an unfolded position (Z2) during drag operation of the folding propeller, so that an automatic rotation of the propeller blades takes place.

17. The folding propeller according to claim 16, wherein the propeller blade arresting means is configured to enable an automatic rotation of the propeller blades for energy recuperation from around 5 kn of speed.

18. The folding propeller according to claim 1, wherein the propeller blades are configured such that an initial opening of the propeller blades takes place by utilising centrifugal force.

19. The folding propeller according to claim 18, wherein the propeller blades include a metallic material, in particular a metal alloy.

20. A drive for a boat comprising a folding propeller, wherein the folding propeller comprises:

a hub, which can be driven via a drive shaft around a rotation axis (A);

at least two propeller blades pivotably arranged on the hub between a folded position (Z1) and an unfolded position (Z2); and a propeller blade arresting means configured for arresting the propeller blades in the unfolded position, wherein the propeller blade arresting means is movable relative to the hub in rotation direction (D) between a starting position (Z10) and an arresting position (Z20).

* * * * *